US007628113B2

(12) United States Patent
Pallo et al.

(10) Patent No.: US 7,628,113 B2
(45) Date of Patent: Dec. 8, 2009

(54) WATER-RESISTANT LINER FOR A SAFE

(75) Inventors: R. David Pallo, Fairport, NY (US); Robert W. Osytek, Seneca Falls, NY (US)

(73) Assignee: John D. Brush & Co., Inc., Rochester, NY (US)

( * ) Notice: Subject to any disclaimer, the term of this patent is extended or adjusted under 35 U.S.C. 154(b) by 376 days.

(21) Appl. No.: 11/736,857

(22) Filed: Apr. 18, 2007

(65) Prior Publication Data

US 2008/0257234 A1 Oct. 23, 2008

(51) Int. Cl.
*E06B 7/16* (2006.01)

(52) U.S. Cl. ..... 109/75; 52/590.2; 109/79; 109/80; 220/23.9; 220/560.01; 220/592.2; 220/849; 277/650; 312/409; 403/329; 403/397

(58) Field of Classification Search ..... 109/75, 109/79–85; 220/849, 560.01, 592.2, 592.23, 220/23.87, 23.9, 62.15, 62.22; 277/650–652, 277/654; 292/DIG. 38; 403/329, 330, 397; 312/296, 409; 52/589.1, 590.1, 590.2
See application file for complete search history.

(56) References Cited

U.S. PATENT DOCUMENTS 1,469,567 A * 10/1923 Whiting et al. ..... 220/324
2,123,501 A * 7/1938 Cunninghame ..... 229/125.16
2,435,006 A * 1/1948 Jeffery ..... 126/20
2,705,575 A * 4/1955 Hammer ..... 220/849
2,767,444 A * 10/1956 Spraragen ..... 277/641
3,038,747 A * 6/1962 Rapata ..... 292/17
3,635,480 A * 1/1972 Bain et al. ..... 277/651
3,650,427 A * 3/1972 Franklin ..... 215/12.1
3,945,329 A * 3/1976 Bywater ..... 109/68
3,971,360 A * 7/1976 Spoeth, Jr. ..... 220/495.05
3,986,721 A * 10/1976 Decker ..... 277/639
4,508,355 A * 4/1985 Ditcher ..... 277/605
4,645,613 A 2/1987 Harvey et al.
4,757,894 A * 7/1988 Schreckenstein ..... 206/3
4,805,290 A 2/1989 Brush, Jr. et al.
4,881,764 A * 11/1989 Takahashi et al. ..... 292/13
4,896,473 A * 1/1990 Liebetrau ..... 52/748.11
4,896,613 A * 1/1990 Salzer ..... 109/27
5,289,658 A * 3/1994 Lusen et al. ..... 49/492.1
5,295,447 A 3/1994 Robbins et al.
5,417,340 A * 5/1995 Anthony ..... 220/830
5,451,082 A * 9/1995 Murai ..... 292/246
5,794,947 A * 8/1998 Shimizu ..... 277/630
6,059,141 A * 5/2000 Wojnowski ..... 220/849

(Continued)

*Primary Examiner*—Lloyd A Gall
(74) *Attorney, Agent, or Firm*—Woods Oviatt Gilman LLP

(57) ABSTRACT

A water-resistant liner insert for a safe is provided. The safe includes top and bottom elements pivotally coupled with one another to define an interior compartment when in a closed position. The liner insert may be coupled with one of the top and bottom elements. The liner insert includes a liner insert body and a resilient gasket. The liner insert body includes a peripheral edge that conforms in shape to interface surfaces on each of the top and bottom elements. The resilient gasket conforms in shape to the peripheral edge of the liner insert body and is coupled with the peripheral edge of the liner insert body. The gasket is configured to be in sealable contact with the interface surfaces of the top and bottom elements when the safe is in the closed position to substantially prevent water from entering the interior compartment of the safe.

12 Claims, 6 Drawing Sheets

U.S. PATENT DOCUMENTS 6,752,092 B2 6/2004 Beattie et al.
2003/0222553 A1* 12/2003 Lee et al. ..... 312/296
2005/0110375 A1* 5/2005 Lim et al. ..... 312/296
2008/0136123 A1* 6/2008 Angot et al. ..... 277/650

* cited by examiner

WATER-RESISTANT LINER FOR A SAFE

FIELD OF THE INVENTION

The present invention relates to a safe, in particular, the present invention is directed to a water-resistant safe for storing and securing valuables, and more particularly, to a safe including a water-resistant liner insert for resisting the entry of water into an interior compartment of the safe.

BACKGROUND OF THE INVENTION

Containers for temporarily protecting their contents from damage from external heat sources, such as fire, are well known. Such containers are said in the art to be fire-resistant and typically are rated for integrity over a specific exposure temperature and/or time. These types of containers typically include a locking mechanism and therefore are known as fire-resistant safes. Various types of fire-resistant safes are available from John D. Brush & Co., Inc, d/b/a/ Sentry Group, Rochester, N.Y. 14625, USA.

A typical fire-resistant safe includes a lid and a base that are pivotally coupled to one another to define an internal compartment therebetween. The lid and base are typically blow-molded to form a hollow space formed between inner and outer shells. The hollow space defined between the inner and outer shells is filled with a non-combustible, fire-proof thermally-insulating material such as hydrated Portland cement. Some examples of existing fire-resistant safes are disclosed in U.S. Pat. No. 4,805,290 to Brush, Jr. et al., U.S. Pat. No. 5,295,447 to Robbins et al., and U.S. Pat. No. 6,752,092 to Beattie et al., the disclosures of which are hereby incorporated by reference.

In addition to providing protection against fire damage, it may also be desirable to protect the contents stored within the interior compartment of a safe against damage from water or moisture entering from outside the safe. For example, U.S. Pat. No. 6,752,092 to Beattie et al. describes a fire and water-resistant safe that includes a gasket positioned at the interface between the lid and the base of the safe when in a closed position. In particular, the '092 patent shows the gasket being positioned within a U-shaped channel defined in the lid having one exposed surface for contacting a corresponding raised sealing portion extending from the base to create a water-resistant seal.

In order to create the water-resistant seal between the lid and the base in the '092 patent, the lid is first moved to a closed position relative to the base so the exposed surface of the gasket is in contact with the raised sealing portion extending from the base. At this point, the gasket is merely resting on the raised sealing portion due to gravity, and the gasket and the raised sealing portion are not in a fully sealed position. In order to fully seal the gasket and raised sealing portion, the lid and the base must be drawn closer together by moving a safe locking mechanism to a locked position, or in some other fashion, such as by ratcheting the lid and the base together, so that the gasket is squeezed against the raised sealing portion. Fully sealing the gasket and the raised sealing portion prevents the entry of water into the interior compartment of the safe.

One drawback of the arrangement disclosed in the '092 patent is that it is difficult to fully seal the gasket with the raised sealing portion. In moving the lid and base toward the fully sealed position, the gasket has a tendency to deform from its original shape when pressed against the raised sealing portion. Given the orientation of the U-shaped channel that the gasket is positioned within, the gasket is generally permitted to deform in one direction when the gasket is drawn against the raised surface portion, which happens to be in the direction of the raised surface portion. Therefore, as a user is applying a force to move the lid closer to the base so that the gasket is in contact with the raised surface portion, the deformation of the gasket creates a resistive force that opposes the user's closing force thereby making it difficult to place the gasket and raised surface portion in a fully sealed position to resist the entry of water into the interior compartment of the safe. As such, a user typically needs to apply a significant amount of force on the lid of the safe to compress the gasket enough so that the safe can be placed in a locked position to maintain the gasket and the raised surface portion in the fully sealed position. Moreover, if the gasket remains in the fully sealed position for a prolonged period of time, the significant force that is imposed on the gasket in this position has a tendency to permanently deform the gasket from its original shape thereby reducing the operational life of the gasket.

Accordingly, there is a need for a water-resistant safe that provides less resistance when placed in a fully sealed water resistant position. There is also a need to prolong the operational life of a gasket provided in a water-resistant safe. The present invention fulfills this need as well as other needs.

SUMMARY OF THE INVENTION

The present invention is directed to a water-resistant liner insert for a safe. The safe may include top and bottom elements that are coupled with one another and define an interior compartment when in a closed position. Each of the top and bottom elements include an interface surface. In one aspect of the present invention, the liner insert may comprise a liner insert body and a resilient gasket. The liner insert body may include a peripheral edge that conforms in shape to the interface surfaces on the top and bottom elements. The resilient gasket generally conforms in shape and is coupled with the peripheral edge of the liner insert body. The gasket is configured to be in sealable contact with the interface surfaces of the top and bottom elements when the safe is in the closed position to substantially prevent water from entering the interior compartment of the safe.

Another aspect of the present invention provides a water-resistant liner insert for a safe. The safe includes top and bottom elements coupled with one another and defining an interior compartment when in a closed position. Each of the top and bottom elements include an interface surface, and one of the top and bottom elements include an undercut. The insert comprises a liner insert body, a rib, and a resilient tube gasket. The liner insert body includes a peripheral edge that conforms in shape to the interface surfaces on the top and bottom elements. The liner insert body includes at least one flexible attachment arm defined therein having a retaining tooth extending therefrom. The retaining tooth is configured to engage the undercut to couple the liner insert body to one of the top and bottom elements. The rib is coupled with the peripheral edge of the liner insert body. The resilient tube gasket defines an inner channel and includes an outer surface. The gasket conforms in shape to the peripheral edge of the liner insert body and the rib is positioned within the inner channel of the gasket. The gasket is configured to be in sealable contact with the interface surfaces of the top and bottom elements when the safe is in the closed position to substantially prevent water from entering the interior compartment of the safe.

The water-resistant liner insert may include first and second surfaces, and wherein the gasket is coupled with the first and second surfaces. The retaining tooth may include a cam surface and a locking surface, wherein the engagement of the undercut with the cam surface flexes the at least one flexible attachment arm relative to the liner insert body. The locking surface may contact the undercut to maintain engagement between the liner insert body and the one of the top and bottom elements. The gasket may be formed of an elastomer and have an outer surface that is cylindrically-shaped. The elastomer that the gasket is formed of may be a polymerization product of ethylene propylene diene monomer (EPDM) or neoprene.

A further aspect of the present invention may include a safe comprising top and bottom elements hingedly coupled with one another, and a liner insert coupled with one of the top and bottom elements. Each of the top and bottom elements define an interior compartment when in a closed position, and each of the top and bottom elements include an interface surface. The liner insert includes a liner insert body and a resilient gasket. The liner insert body includes a peripheral edge that conforms in shape to the interface surfaces on the top and bottom elements. The resilient gasket conforms in shape to the peripheral edge of the liner insert body and is coupled with the peripheral edge of the liner insert body. The gasket is configured to be in sealable contact with the interface surfaces of the top and bottom elements when the safe is in the closed position to substantially prevent water from entering the interior compartment of the safe.

The undercuts on the safe may include a top surface, first and second side surfaces connected to the top surface, a first end surface connected to the top surface and first and second side surfaces, and a second end surface connected to the top surface and first and second side surfaces. The first and second side surfaces may be substantially parallel with one another, and the first end surface may be positioned at an obtuse angle relative to the top surface. The second end surface includes a tip portion and a concave arc portion, wherein the top portion is flat and extends from the top surface of the undercut at an acute angle. The concave arc portion extends from the tip portion and underlies the top surface thereby forming a hook-shaped fastener for attaching the retaining tooth to the undercut.

Further, the top and bottom elements may both include an inner shell and an outer shell, wherein the inner and outer shells are spaced apart to define an insulation cavity. Fire-resistant insulation may be positioned within the insulation cavities of the top and bottom elements so that the safe is fire-resistant. Also, top and bottom elements, as well as the lid insert body may be formed of a thermoplastic resin. The safe may further comprise a latch for maintaining the top and bottom elements in the closed position, and a lock for selectively fastening the top element to the bottom element.

By providing the liner insert in accordance with the present invention, a number of advantages are realized. For example, by coupling the gasket with the peripheral edge of a liner insert body, the gasket is permitted to deform in a direction that does not oppose the force that is used to move the safe to a fully sealed position. Therefore, the use of the liner insert in a safe makes it easier for a user to position the safe in the fully sealed position. Furthermore, the gasket used with the liner insert is necessarily not placed in an extreme amount of pressure that would prematurely cause the gasket to permanently deform from its original shape.

BRIEF DESCRIPTION OF THE DRAWINGS

The above-mentioned and other features and advantages of this invention, and the manner of attaining them, will become apparent and be better understood by reference to the following description of the invention in conjunction with the accompanying drawing, wherein.

DETAILED DESCRIPTION OF THE INVENTION

Figure 1A:
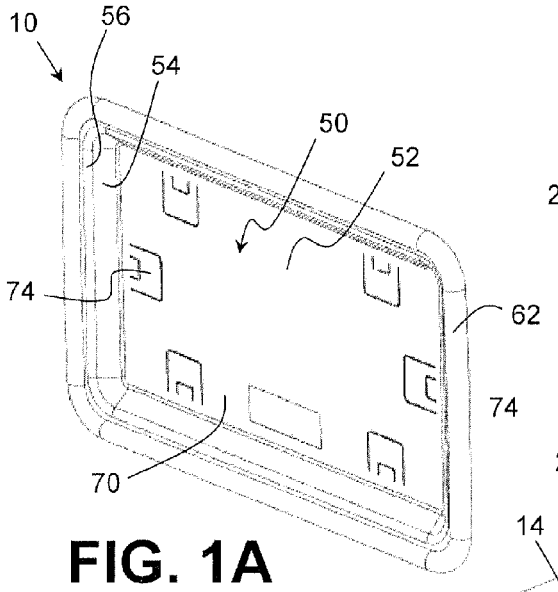
FIG. 1A is a perspective view of a water-resistant liner insert in accordance with the present invention.
Figure 1B:
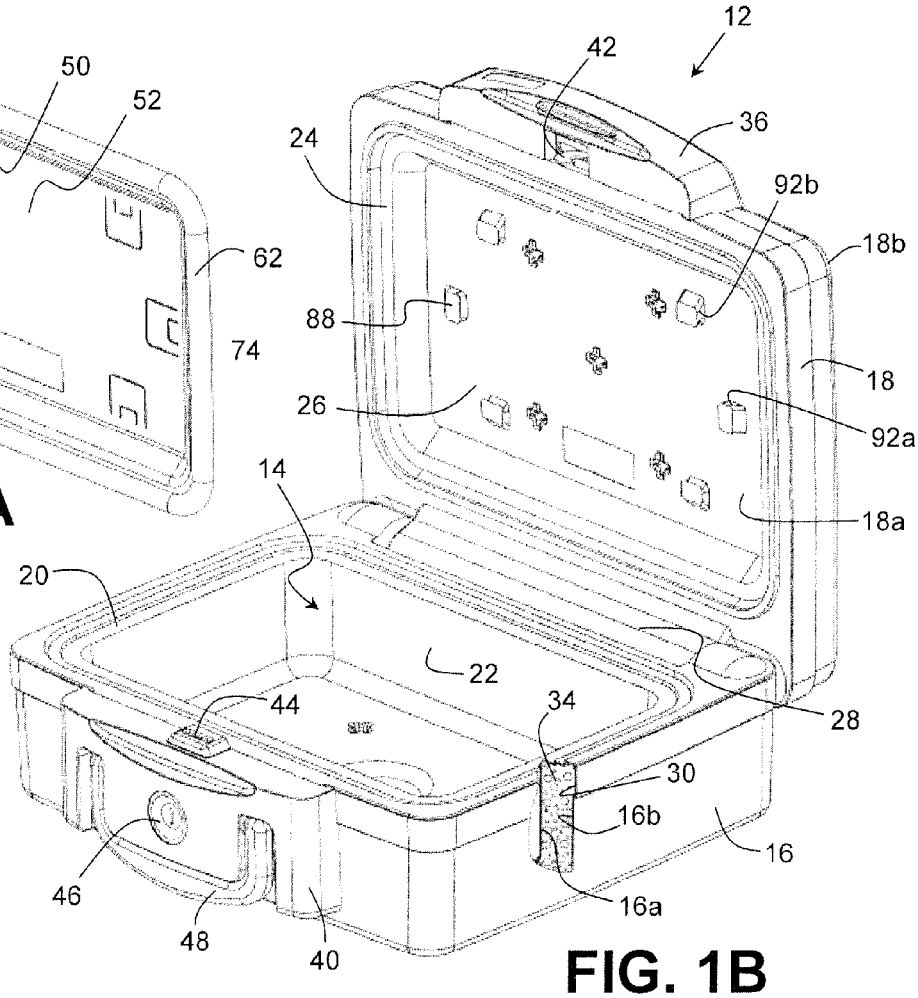
FIG. 1B is a perspective view of a fire-resistant safe in which the liner insert shown in FIG. 1A may be installed.

Referring to the drawings in details, and specifically FIGS. 1A and 1B, a water-resistant liner insert is provided in accordance with one embodiment of the present invention and is designated with reference numeral 10. As will be explained in more detail below, lid insert 10 may be coupled to a container or safe 20 to substantially prevent water or moisture from entering an interior compartment 14 of safe 12 and thereby damage contents that are positioned therein.

As best seen in FIG. 1B, safe 12 may generally include a bottom element or base 16, and a top element or lid 18, wherein each of bottom and top elements 16, 18 are formed by blow-molding thereby providing an inner shell 16*a*, 18*a* and an outer shell 16*b*, 18*b*, respectively. Inner shell 16*a* and outer shell 16*b* of bottom element 16 are formed to provide a bottom interface surface 20, and inner shell 16*a* defines a first compartment 22 for the storage of valuables. Inner shell 18*a* and outer shell 18*b* are formed to provide a top interface surface 24 that is configured to oppose bottom interface surface 20. Inner shell 18*a* further defines a second compartment 26. When safe 12 is in a closed position, first and second compartments 22, 26 may be combined to define the interior compartment 14. While interface surfaces 20, 24 as shown as being rectilinear in shape, it will be understood that interface surfaces 20, 24 may also be configured in other shapes.

Figure 8:
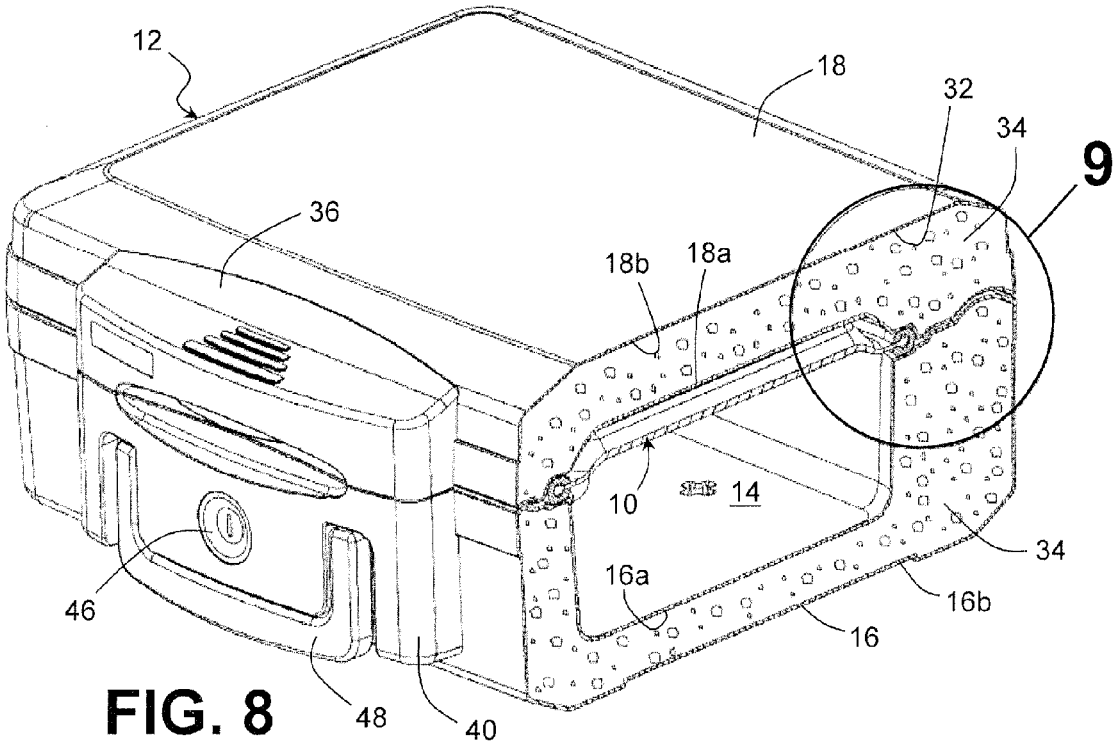
FIG. 8 is a cross-sectional view of the safe showing the lid coupled with the safe's bottom element or base in a closed position with the liner insert located between the interfaces of the lid and base.

A hinge 28 may be used to join top element 18 and bottom element 16 thereby enabling top element 18 to be pivoted relative to bottom element 16 to move between an opened position, as shown in FIG. 1B, and a closed position, as shown in FIG. 8, so that bottom interface surface 20 and top interface surface 24 may be adjacent to one another. It will be understood that lid insert 10 will be positioned between interface surfaces 20, 24 to prevent water or moisture from entering interior compartment 14, which will be discussed in more detail below.

An insulation cavity 30 is defined between inner shell 16*a* and outer shell 16*b* of bottom element 16, and another insulation cavity 32 (FIG. 8) is defined between inner shell 18*a* and outer shell 18*b* of top element 18. A thermally insulating fire-resistant material 34 is disposed in insulation cavity 30, 32 between inner shells 16*a*, 18*a* and outer shells 16*b*, 18*b* of top and bottom elements 18, 16. The thermally insulating fire-resistant material 34 may be a hydrated Portland cement. In addition, the fire-resistant material that may be used in the insulation cavities may include, but is not limited to, one or more of an insulative mineral wool, a sodium silicate intumescent material, and insulation that is described in Sentry's U.S. Pat. No. 4,645,613, which is hereby incorporated by reference in its entirety. The inner shells 16*a*, 18*a* and outer shells 16*b*, 18*b* of top and bottom elements 18, 16 may be formed of a polymeric resin, for example, high density polyethylene (HDPE), that has a melting point higher than the boiling point of water. The water of hydration thus prevents the inner and outer shells, especially the outer shells, from melting or igniting for an extended period of time.

Figure 2:
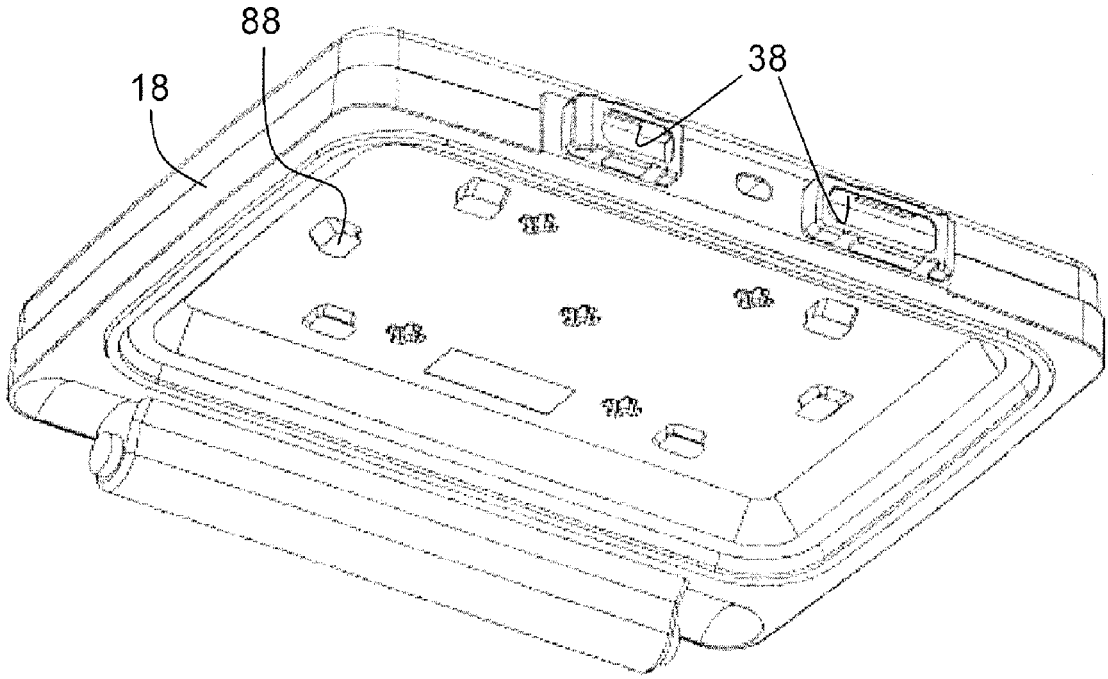
FIG. 2 is a perspective view of a top element or lid of the fire-resistant safe shown in FIG. 1B without an escutcheon plate and before installation of the liner insert of the present invention.

As best seen in FIGS. 1B, 2 and 8, safe 12 may further include an upper escutcheon plate 36 extending outwardly from top element 18 and anchored within insulation 34 located within insulation cavity 32 formed between inner and outer shells 18*a*, 18*b* through insulation fill ports 38. Safe 12 may also include a lower escutcheon plate 40 extending outwardly from bottom element 16 and anchored within insulation 34 located within insulation cavity 30 formed between inner and outer shells 16*a*, 16*b* through insulation fill ports, similar to those shown for the top element 18. A corresponding pair of latch elements 42 and 44 are mounted within escutcheon plates 36, 40 and may be used to maintain top and bottom elements 16, 18 in a closed position, as shown in FIG. 8. Specifically, a locking mechanism 46 may be used to engage latch element 44 with latch element 42 so that top element 18 is securely fastened to bottom element 16 thereby securing any valuables contained within interior compartment 14 of safe 12. A handle 48 may also be provided on safe 12.

In accordance with the present invention, liner insert 10 may be used with any type of container to prevent water or moisture from entering an interior compartment of the container. For example, as best seen in FIGS. 1A and 1B, liner insert 10 is being used with fire-resistant safe 12. In this particular example, liner insert 10 will be described as being coupled to top element 18, however, it will be understood that liner insert 10 may also be coupled with bottom element 16. Liner insert 10 may be formed from a thermoplastic resin such as, for example, high density polyethylene (HDPE).

As best seen in FIGS. 1A, 1B, 6 and 7, liner insert 10 may include a liner insert body 50 including a recessed portion 52 surrounded by a tapered section 54, with a flange 56 surrounding tapered section 54. The combination of recessed portion 52 and tapered section 54 may be configured to fit the profile of inner shell 18*a* so that an intermediate space 57 between liner insert 10 and lid 18 is minimized. It should also be understood that liner insert body 50 may take other forms, including a planar configuration. Liner insert body 50, and particularly the flange 56, includes a peripheral edge 58 that conforms in shape to interface surfaces 20, 24 on bottom and top elements 16, 18, respectively. Furthermore, a rib 60 may be coupled with peripheral edge 58 of flange 56, which also conforms in shape to interface surfaces 20, 24 on bottom and top elements 16, 18, respectively.

Liner insert 10 also includes a resilient gasket 62 that is coupled with the entire peripheral edge 58 of liner insert body 50, such that gasket 62 conforms in shape to both peripheral edge 58 and interface surfaces 20, 24 on bottom and top elements 16, 18, respectively. Gasket 62 may be formed from an elastomer such as, for example, an elastomeric polymerization product of ethylene propylene diene monomer (EPDM) or neoprene. Gasket 62 may be coupled with peripheral edge 58 in any appropriate manner using adhesive, any elastic characteristics of gasket 62, or by forming gasket 62 in a manner that will prevent gasket 62 from being removed from peripheral edge 58 or rib 60.

Figure 7:
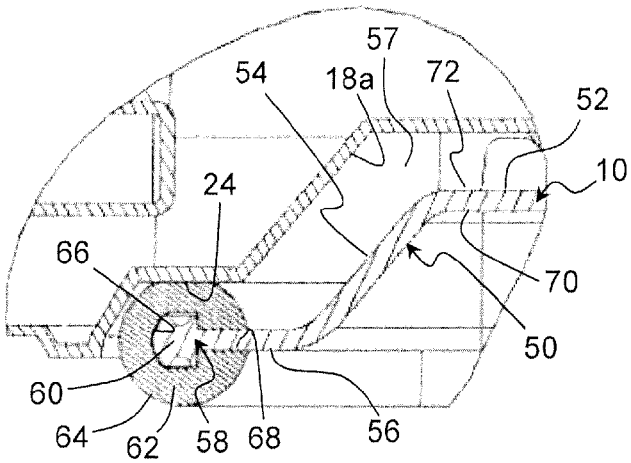
FIG. 7 is an enlarged view taken from FIG. 6 of the gasket positioned on the peripheral edge of the liner insert.

As best seen in FIG. 7, gasket 62 may be formed in a tubular shape so that gasket 62 is securely positioned on rib 60. In particular, gasket 62 may include a cylindrically-shaped outer surface 64 adapted for contact with interface surfaces 20, 24 when safe 12 is in the closed and fully sealed position. Gasket 62 may also have a inner channel 66 defined therein that is configured to allow rib 60 to be positioned therein. Gasket 62 may further include an opening or slit 68 that allows rib 60 to be inserted into inner channel 66 and results in gasket 62 being coupled with first and second surfaces 70, 72 of liner insert body 50.

Figure 3:
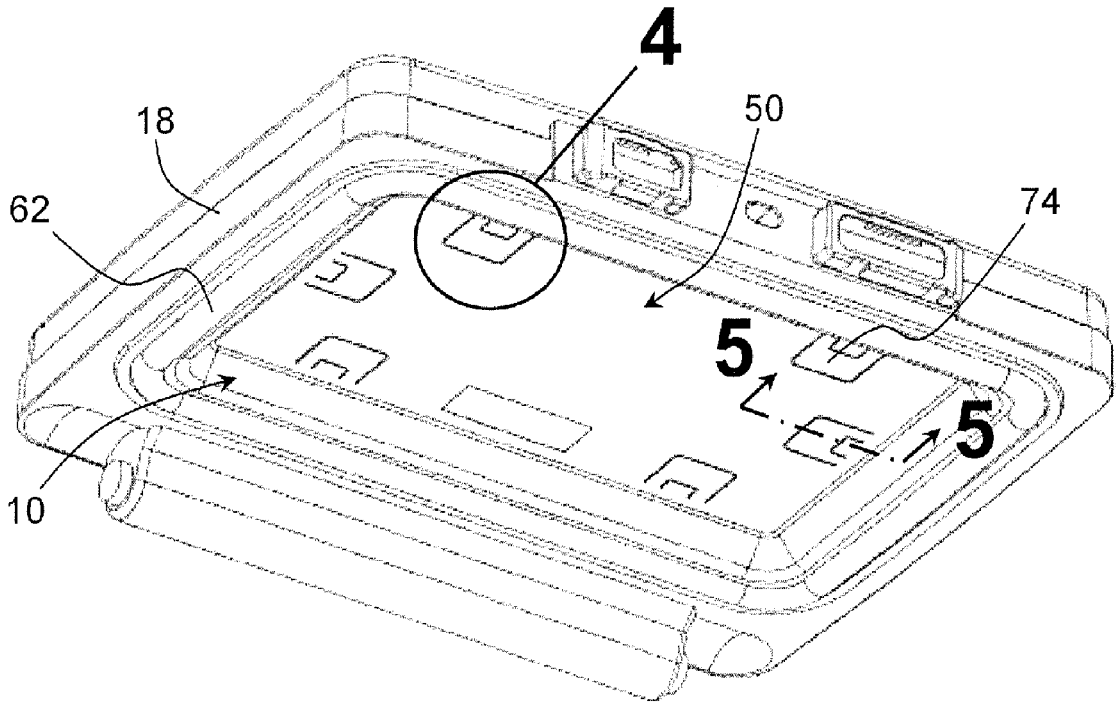
FIG. 3 is a perspective view of the top element or lid of the fire-resistant safe shown in FIG. 1B without an escutcheon plate and after installation of the liner insert of the present invention.
Figure 4:
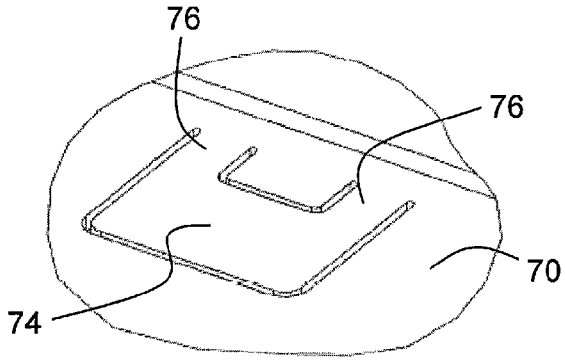
FIG. 4 is an enlarged view taken from FIG. 3 of a flexible attachment arm formed in the liner insert.
Figure 5:
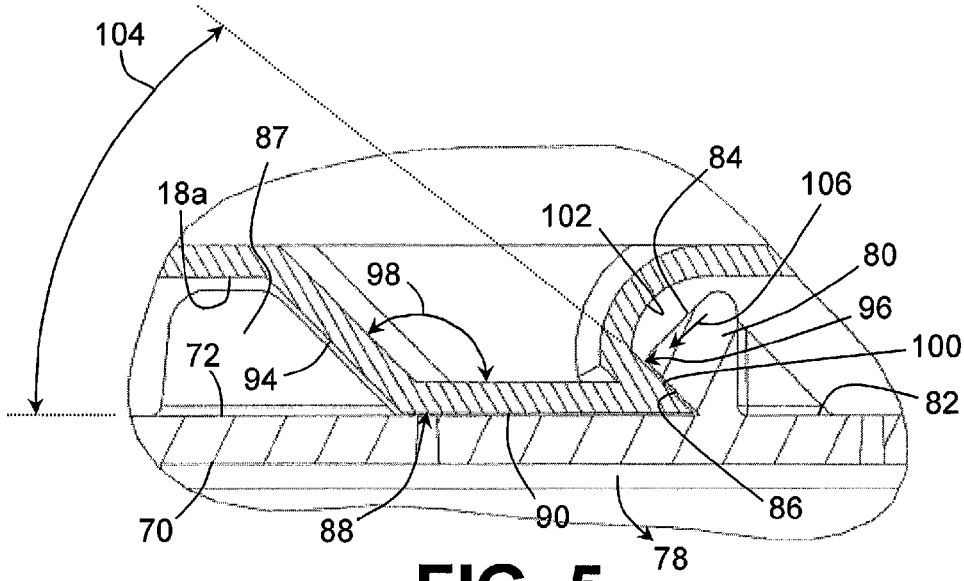
FIG. 5 is a cross-sectional view taken along line 5-5 in FIG. 3 of the flexible attachment arm coupled with an undercut formed on the lid of the safe.

Liner insert 10 may be coupled with either top or bottom elements 16, 18 in any number of methods including, but not limited to, welding, using mechanical fasteners, and the like. In the example illustrated in the accompanying drawings, and specifically FIGS. 1A, 3-5 and 10, liner insert 10 may be fastened to top element 18 using a plurality of flexible attachment arms 74 that are defined in liner insert body 50. As best seen in FIGS. 4 and 5, each flexible attachment arm 74 may be generally U-shaped and is adapted to flex about to common connection points 76 with liner insert body 50 in a direction 78. With specific reference to FIGS. 5 and 10, each attachment arm 74 may have a retaining tooth 80 that extends outwardly from surface 72. In addition, each retaining tooth 80 includes a cam surface 84 and a locking surface 86. Moreover, a plurality of angled guides 87 also may extend outwardly from surface 72 of liner insert 10, wherein each of the guides 87 are paired with a corresponding attachment arm 74.

As best seen in FIGS. 1B, 2 and 5, the above-described flexible attachment arms 74 that are defined in liner insert body 50 may be used in conjunction with a corresponding number of undercuts 88 that are formed with inner shell 18*a* of top element 18. Specifically, undercuts 88 may be integrally formed with inner shell 18*a* of top element 18 during the blow molding process. In other words, inner shell 18*a* and undercuts 88 are essentially one continuous element so that undercuts 88 are actually formed as a part of top element 18. It should be understood that undercuts 88 may also be formed in inner shell 16*a* of bottom element 16 if liner insert 10 were to be coupled with bottom element 16.

As best seen in FIGS. 1B and 5, undercut 88 may include a substantially flat top surface 90, and substantially flat parallel side surfaces 92*a*, 92*b* that extend perpendicularly from inner shell 18*a* and are connected to top surface 90. Side surfaces 92*a*, 92*b* may be substantially perpendicular to top surface 90. Undercut 88 may further include a first end surface 94 and a second end surface 96. First end surface 94 may be substantially flat and is connected to both side surfaces 92*b*, 92*b* and top surface 90. Further, first end surface 94 preferably forms an obtuse angle 98 with top surface 90. For example, obtuse angle 98 may be 135 degrees. Second end surface 96 may include both a tip portion 100 and a concave arc portion 102. Tip portion 100 is generally flat and extends from top surface 90 toward inner surface 18*a* at an acute angle 104 relative to top surface 90, for example, at an angle of 45 degrees. At point located between top wall 90 and inner shell 18*a*, tip portion 100 ends and concave arc portion 102 begins, wherein concave arc portion 102 extends from tip portion 100, underlies top surface 90, and is integrally formed with inner shell 18*a*. For example, concave arc portion 102 may have a radius of curvature of approximately 0.120 inches. Second end surface 96 thereby defines an overhang or hook-shaped fastener which may be used to attach liner insert 10, particularly retaining teeth 80, to top element 18 of safe 12.

Figure 6:
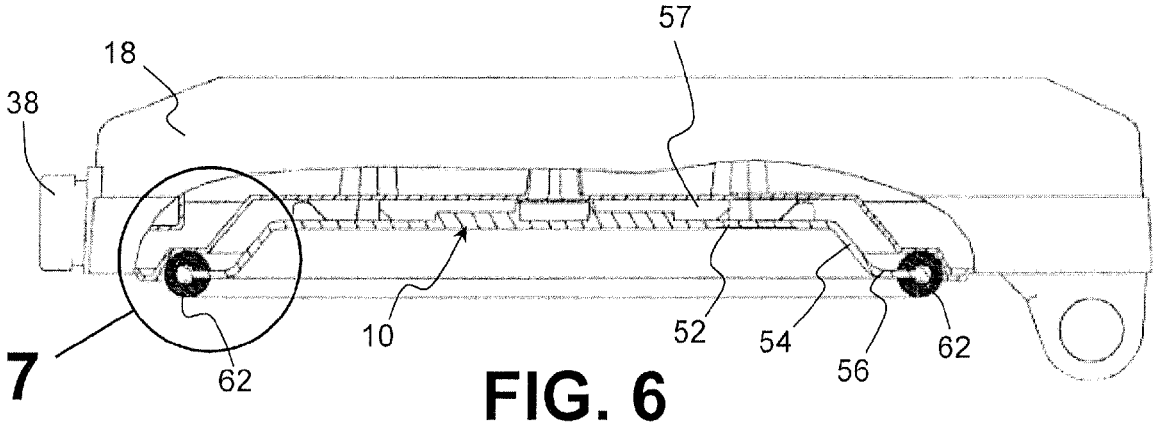
FIG. 6 is a side view of the lid and liner insert shown in FIG. 3 with portions broken away showing a gasket positioned on the peripheral edge of the liner insert.
Figure 10:
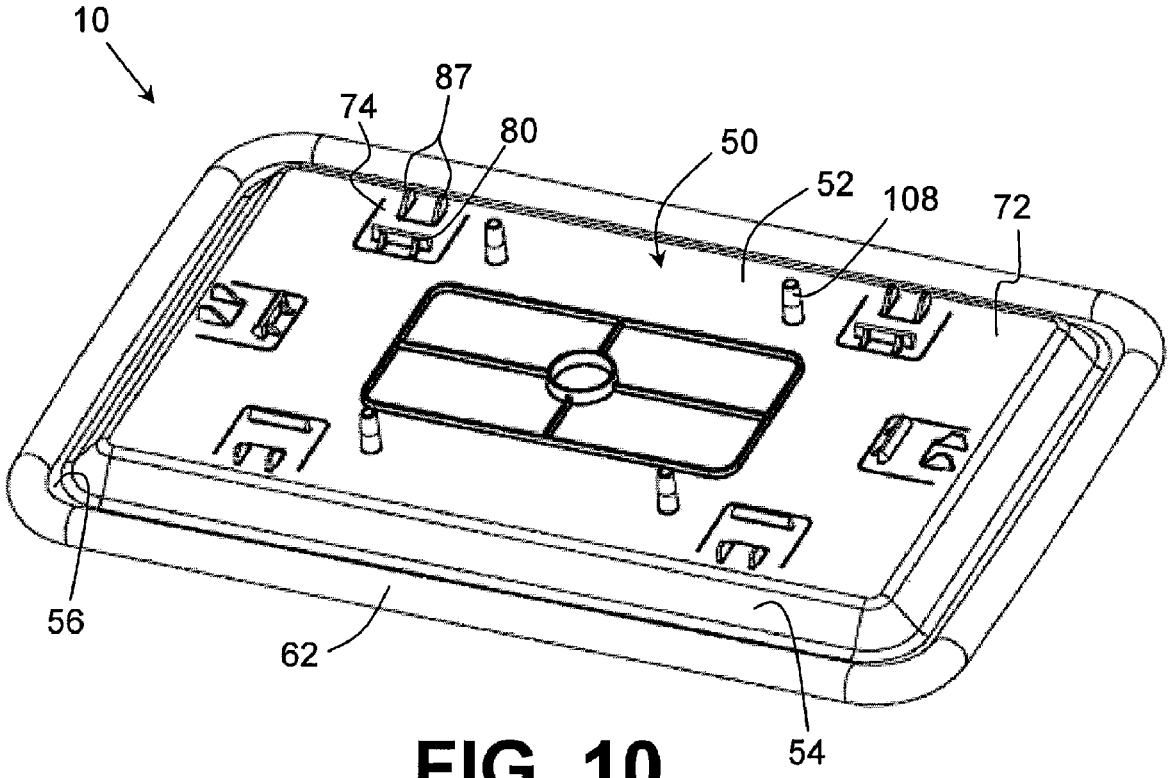
FIG. 10 is a perspective view of the liner insert showing a retaining tooth extending from each of the flexible attachment arms.

In fastening liner insert 10 to top element 18, second surface 72 of liner insert body 50 is placed adjacent to inner shell 18*a* so that the cam surfaces 84 on each of the retaining teeth 80 are in contact with the end of tip portion 100 of the corresponding undercut 88. A force is then applied to liner insert 10 toward top element 18 so that the engagement of undercut 88 with cam surface 84 causes attachment arm 74 to flex relative to liner insert body 50 in direction 78. At this point, first end surface 94 may be sliding along the surface of angled guide 87 to properly position liner insert 10 relative to undercut 88. The end of tip portion 100 continues to ride along cam surface 84 in a direction 106 and attachment arm 74 continues to flex until tip portion 100 is no longer in contact with cam surface 84. Attachment arm 74 then snaps back into the position shown in FIG. 5 so that tip portion 100 of undercut 88 is in contact with locking surface 86 to maintain engagement between liner insert 10 and top element 18, as best seen in FIGS. 3, 5 and 6. Further, first end surface 94 is positioned adjacent to angled guide 87. As best seen in FIG. 10, liner insert 10 may also include one or more posts 108 that extend outwardly from second surface 72 of liner insert 10 a distance that will limit the liner insert 10 from over-flexing when being pushed toward inner shell 18*a* to fasten the liner insert 10 to top element 18. As best seen in FIGS. 6 and 7, when liner insert 10 is fastened to top element 18, the outer surface of gasket 62 corresponds to and may be in contact with top interface surface 24 of top element 18.

Figure 9:
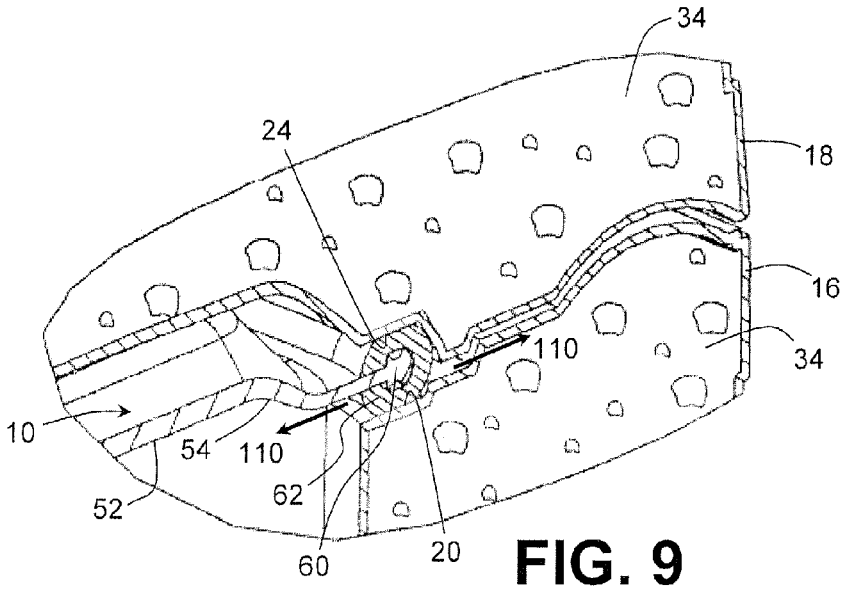
FIG. 9 is an enlarged view taken from FIG. 8 showing the gasket positioned between the interfaces of the lid and base of the safe.

As best seen in FIGS. 8 and 9, after liner insert 10 is fastened to top element 18, safe 12 may then be moved to a closed or fully sealed position to substantially prevent water or moisture from entering internal compartment 14 with relative ease. As stated above, the outer surface of gasket 62 corresponds to and may be in contact with top interface surface 24 of top element 18 after liner insert 10 is fastened to top element 18. Top element 18 is then pivoted relative to bottom element 16 such that bottom interface surface 20 is also placed in contact with gasket 62. At this point, both interface surfaces 20, 24 are in contact with gasket 62. In order to place safe 12 in the fully sealed position to substantially prevent water or moisture from entering interior compartment 14, top and bottom elements 16, 18 need to be drawn together by latching them to one another 16, 18 or using the locking mechanism 46 to place the top and bottom elements 16, 18 in a secure position.

By providing a liner insert in accordance with the present invention, a number of advantages are realized. For instance, the amount of force necessary to draw the top and bottom elements 16, 18 together is substantially reduced in the present invention compared to the amount of force that is necessary in existing water-resistant safes. In some existing water-resistant safes, the deformation of the gasket when moving the safe to a fully sealed position creates a resistive force that directly opposes the user's closing force thereby making it difficult to place the gasket and raised surface portion in the fully sealed position. The resistive force that is generated in existing designs is not present in the above-described invention.

With reference to FIG. 9, as top and bottom elements 16, 18 are drawn closer together, gasket 62 is squeezed or otherwise deformed to create the water-resistant seal between interface surfaces 20, 24. Since gasket is positioned on the peripheral edge of liner insert 10 and not confined in an outward direction 110 that is perpendicular to the direction of the force being imposed on top and bottom elements 16, 18, gasket 62 is permitted to deform in outward direction 110. Deformation of the gasket 62 in outward direction 110 does not create a resistive force that directly opposes the user's closing force, thus making it easier for safe 12 to be moved to the fully sealed position. Furthermore, the present invention also does not necessarily place gasket 62 in an extreme amount of pressure that would prematurely cause gasket 62 to permanently deform from its original shape.

The invention has been described in detail for the purpose of illustration, but it is understood that such detail is solely for that purpose, and variations can be made by those skilled in the art without departing from the spirit and scope of the invention, which is defined by the following claims.

What is claimed:

1. A safe comprising:

top and bottom elements pivotally coupled with one another and defining an interior compartment when in a closed position, each of the top and bottom elements including an interface surface; and a liner insert coupled with one of said top and bottom elements, said liner insert including:

a liner insert body including a peripheral edge that conforms in shape to said interface surfaces on said top and bottom elements, said liner insert body including at least one flexible attachment arm defined in said liner insert body, said at least one flexible attachment arm having a retaining tooth extending therefrom; and a resilient gasket conforming in shape to said peripheral edge of said liner insert body, said gasket being coupled with said peripheral edge of said liner insert body, wherein said one of said top and bottom elements includes an undercut, wherein said undercut includes:

a top surface;

first and second side surfaces connected to the top surface, wherein the first and second side surfaces are substantially parallel with one another;

a first end surface connected to the top surface and first and second side surfaces, wherein the first end surface is positioned at an obtuse angle relative to the top surface; and a second end surface connected to the top surface and first and second side surfaces, wherein said second end surface includes a tip portion and a concave arc portion, wherein said tip portion is flat and extends from said top surface at an acute angle, and wherein said concave arc portion extends from said tip portion and underlies said top surface thereby forming a hook-shaped fastener for attaching said retaining tooth to said undercut wherein said retaining tooth engages said undercut to couple said liner insert body to said one of said top and bottom elements, and wherein said gasket is configured to be in sealable contact with said interface surfaces of said top and bottom elements when the safe is in the closed position to substantially prevent water from entering said interior compartment of the safe.

2. A safe in accordance with claim 1, wherein said gasket includes a cylindrically-shaped outer surface.

3. A safe in accordance with claim 2, wherein said gasket is formed as a tube defining an inner channel, wherein a rib is coupled with said peripheral edge of said liner insert body, and wherein said rib is positioned within said inner channel.

4. A safe in accordance with claim 3, wherein said liner insert body includes first and second surfaces, and wherein said gasket is coupled with said first and second surfaces.

5. A safe in accordance with claim 1, wherein said retaining tooth includes a cam surface and a locking surface, wherein the engagement of the undercut with said cam surface flexes said at least one flexible attachment arm relative to said liner insert body, and wherein said locking surface contacts said undercut to maintain engagement between said liner insert body and said one of said top and bottom elements.

6. A safe in accordance with claim 1, wherein said top element includes an inner shell and an outer shell, wherein said inner and outer shells are spaced apart to define an insulation cavity, and wherein said bottom element includes an inner shell and an outer shell, wherein said inner and outer shells are spaced apart to define an insulation cavity, wherein fire-resistant insulation is positioned within said insulation cavities of said top and bottom elements.

7. A safe in accordance with claim 6, wherein said top and bottom elements are formed of a thermoplastic resin.

8. A safe in accordance with claim 1, wherein said gasket is formed of an elastomer.

9. A safe in accordance with claim 1, wherein said liner insert body is formed of a thermoplastic resin.

10. A safe in accordance with claim 1, wherein said top and bottom elements are pivotally coupled with one another by a hinge.

11. A safe in accordance with claim 1, further comprising a latch for maintaining said top and bottom elements in the closed position.

12. A safe in accordance with claim 1, further comprising a lock for selectively fastening the top element to the bottom element.

* * * * *